US011786022B2

(12) United States Patent
Parker

(10) Patent No.: US 11,786,022 B2
(45) Date of Patent: Oct. 17, 2023

(54) BAG SYSTEM

(71) Applicant: Linda Kay Parker, Denton, TX (US)

(72) Inventor: Linda Kay Parker, Denton, TX (US)

( * ) Notice: Subject to any disclaimer, the term of this patent is extended or adjusted under 35 U.S.C. 154(b) by 618 days.

(21) Appl. No.: 16/691,421

(22) Filed: Nov. 21, 2019

(65) Prior Publication Data

US 2020/0405025 A1 Dec. 31, 2020

Related U.S. Application Data

(63) Continuation-in-part of application No. 16/455,487, filed on Jun. 27, 2019, now Pat. No. 11,553,765.

(51) Int. Cl.

| | |
|---|---|
| ***A45C 7/00*** | (2006.01) |
| ***A44B 11/00*** | (2006.01) |
| ***A45C 13/10*** | (2006.01) |
| ***A45C 3/06*** | (2006.01) |

(52) U.S. Cl.
CPC ..... *A45C 7/0086* (2013.01); *A44B 11/005* (2013.01); *A45C 13/10* (2013.01); *A45C 3/06* (2013.01)

(58) Field of Classification Search
CPC .... A44B 11/26; A44B 11/005; F16M 13/005; E05C 19/02; Y10S 292/04; Y10T 292/696; A45C 7/0086; A45C 13/10; A45C 3/06; A45C 13/1084
See application file for complete search history.

(56) References Cited

U.S. PATENT DOCUMENTS

| | | | | |
|---|---|---|---|---|
| 2,899,999 A | | 8/1959 | Dobbs | |
| 2,989,998 A | * | 6/1961 | Harris | A45C 7/0086 D3/319 |
| 3,371,511 A | | 3/1968 | Atkinson | |
| 3,605,210 A | | 9/1971 | Lohr | |
| 3,696,850 A | * | 10/1972 | Rosenblum | A45C 7/0086 190/110 |
| 3,727,657 A | | 4/1973 | Landis | |
| 4,081,061 A | | 3/1978 | Tucker | |
| 4,250,938 A | * | 2/1981 | Siegel | A45C 3/06 150/113 |

(Continued)

FOREIGN PATENT DOCUMENTS

| | | |
|---|---|---|
| CN | 205030651 U | 2/2016 |
| GB | 840343 | 7/1960 |

OTHER PUBLICATIONS

Fairwin: Tactical Belt: https://www.amazon.com/Fairwin-Tactical-Heavy-Military-Concerled/dp/B07JYQ3BTB?th=1 (Year: 2018).*

(Continued)

*Primary Examiner* — John K Fristoe, Jr.
*Assistant Examiner* — Justin Caudill
(74) *Attorney, Agent, or Firm* — Jason P. Webb; Pearson Butler

(57) ABSTRACT

There is a bag system, comprising: a main bag, including a front side, wherein: a slit is disposed along the front side; and a buckle is coupled to an interior surface of the front side; and a supplemental bag, removably coupled to the main bag, and including a connector, wherein: the connector is disposed along a back side of the supplemental bag; and the connector is disposed through the slit and removably coupled to the buckle, the connector and the buckle thereby comprising a latch assembly.

20 Claims, 8 Drawing Sheets

(56) References Cited

U.S. PATENT DOCUMENTS 4,263,951 A 4/1981 Siegel
4,321,734 A 3/1982 Gandelman
4,419,794 A * 12/1983 Horton, Jr. ..... F16B 21/04 24/669
4,424,841 A 1/1984 Smith
4,453,743 A 6/1984 Sanders et al.
4,673,070 A * 6/1987 Ambal ..... A45C 7/0086 190/110
4,766,654 A 8/1988 Sugimoto
4,792,165 A 12/1988 Nishimura
5,186,290 A 2/1993 Takayama
5,209,279 A 5/1993 Wilson
5,217,262 A 6/1993 Kurosaki
5,273,328 A 12/1993 Kurosaki
5,327,619 A * 7/1994 Ortega ..... A44B 11/266 24/616
5,402,869 A 4/1995 Saltzman et al.
5,419,020 A * 5/1995 Murai ..... A44B 11/266 24/633
5,489,021 A 2/1996 Wallingford
5,509,515 A 4/1996 Guo
5,557,954 A 9/1996 Ling
5,604,958 A * 2/1997 Anscher ..... A45F 3/04 24/165
5,971,119 A * 10/1999 Chi ..... A45C 13/30 190/110
6,012,557 A 1/2000 Derelanko
6,098,769 A * 8/2000 Yen ..... A45C 13/26 190/110
6,213,266 B1 4/2001 Hollingsworth
6,257,381 B1 7/2001 Harfst
6,446,688 B1 9/2002 Sutton
6,454,320 B1 9/2002 Weinerman et al.
6,669,248 B2 12/2003 Shirase
7,055,564 B2 6/2006 Carey et al.
7,600,620 B2 * 10/2009 Hammond ..... A45C 7/009 190/102
7,828,457 B2 11/2010 Davidoff et al.
9,226,557 B2 1/2016 Sullivan
9,578,929 B2 * 2/2017 Hung ..... A44B 11/2511
9,986,813 B2 * 6/2018 Nakamura ..... A63F 9/10
10,226,109 B1 * 3/2019 Calder ..... A45C 1/02
2002/0121322 A1 9/2002 Seamon
2003/0102063 A1 6/2003 Brody
2003/0230701 A1 * 12/2003 Chang ..... D04D 9/04 248/682
2006/0180624 A1 * 8/2006 Sadow ..... A45C 7/009 224/582
2007/0102077 A1 5/2007 Parker-Ogden
2007/0228097 A1 * 10/2007 Recanati ..... B60R 7/043 190/110
2008/0011567 A1 1/2008 Hammond
2008/0060953 A1 3/2008 Ghassan
2009/0084475 A1 4/2009 Dean-Perry
2009/0107021 A1 * 4/2009 Koeppel ..... A45C 13/02 428/542.2
2011/0309124 A1 * 12/2011 Dubois ..... A45F 3/04 224/628
2012/0073995 A1 * 3/2012 Parker ..... A45C 13/10 206/1.5
2012/0124790 A1 * 5/2012 Richards ..... A44B 11/2519 24/593.1
2013/0334271 A1 * 12/2013 Alliegro ..... A45F 3/00 224/576
2015/0014949 A1 * 1/2015 Dittman ..... A45C 5/14 280/47.17
2015/0122381 A1 5/2015 Morrison
2015/0305465 A1 * 10/2015 Barker ..... A45C 13/08 150/104
2016/0318662 A1 11/2016 De Leon
2017/0234647 A1 * 8/2017 Schweitzer ..... A45C 3/06 224/587
2017/0319920 A1 * 11/2017 Filip ..... A63B 55/408

OTHER PUBLICATIONS

Fairwin: Tactical Belt: https://www.amazon.com/dp/B07MNBKBJH/ (Year: 2018).*
Southco: Southco 60: https://www.amazon.com/Southco-60-10-101-12-60-Squeeze-Release-Latches/dp/B01A97XQ9A (Year: 2016).*
Southco: Southco 60: https://files.southco.com/static/Literature/60.en.pdf (Year: 2016).*
My Rustic Store: Shelf Bracket: https://www.amazon.com/Brackets-Shelves-Bracket-Industrial-Bracket/dp/B07QGPR3V4 (Year: 2018).*

* cited by examiner

BAG SYSTEM

CROSS-REFERENCE TO RELATED APPLICATIONS

This invention is a continuation-in-part under 37 CFR 1.53(b) and claims priority, under 35 U.S.C. § 120, to the U.S. patent application Ser. No. 16/455,487 by Linda Kay Parker filed on Jun. 27, 2019, which is incorporated by reference herein in its entirety.

BACKGROUND OF THE INVENTION

Field of the Invention

The present invention relates to bag systems, specifically to bag systems for securely coupling bags together.

Description of the Related Art

In the related art, it has been known to combine supplemental bags with main bags to carry additional items. Purses are used to carry a variety of personal effects Such as keys, identification cards, credit cards, cash, cell phones, eyewear, medications and makeup. The entire contents of the purse are considered essential to a person's daily life, though the type of purse or bag one carries throughout the day will often vary.

Purses are used as a fashion accessory and are often selected to coordinate with an outfit or occasion. Purses can be selected based on their utility or appropriateness such as a purse chosen for a casual outdoor activity versus a formal occasion. When switching from one purse or bag to another, the user is required to transfer each, individual item to the next desired style. This process is time consuming, burdensome and may not result in the same organization of contents, making the search for a given item a constant challenge. The transfer process may also result in some items being left behind or lost.

In addition, persons often need to carry or transport additional items that may not fit in a main bag. More, persons may have a desire to keep items separate as it is difficult to access specific items when such items are stored together in a single large compartment. As a result, persons are forced to carry additional bags or use other cumbersome solutions to transport additional items.

Bags of bag systems may be coupled together for transporting items. A number of separate pieces may be used separately and carried separately, or a number of separated pieces may be secured together so as to function as a unitary structure. While the separate pieces are capable of functioning independently of one another, they may be secured together while traveling to make the handling of the bags more manageable. For instance, bags may be coupled together through a variety of coupling mechanisms, such as: straps, zippers, hooks, snaps, belts, buckles, hook and loop, and so on.

Some improvements have been made in the field. Examples of references related to the present invention are described below in their own words, and the supporting teachings of each reference are incorporated by reference herein:

U.S. Pat. No. 2,989,998, issued to Harris, discloses in combination, a bag and an auxiliary container mounted on said bag, said bag having opposed flat side walls providing an opening along the top edge of said bag, a closing flap secured to one of said side walls and extending over said opening, and latch means on the other side wall for engaging said closing flap, said auxiliary container having opposed flat side walls providing an opening along one edge thereof and closure means for said opening, and means for detachably connecting said container to said bag with one side wall of said container in close contact throughout the extent thereof with said one side Wall of the bag, said connecting means comprising a pair of laterally spaced latch means projecting outwardly from said one side wall of the bag adjacent the top edge thereof and a pair of laterally spaced openings in said one side wall of the container for receiving the respective latch means, whereby said container is held in depending and closely abutting relation to said bag and the closure means on the container may be opened to gain access to said pair of spaced latch means for manipulation thereof to detach the container from said bag while leaving said bag in a closed condition.

U.S. Pat. No. 3,696,850, issued to Rosenblum, discloses an item of luggage to be hand-carried when travelling, especially on airplanes, buses, trains or other public conveyances to enable the articles contained in the luggage to be immediately available and to eliminate the possibility of luggage becoming lost in transit. The luggage includes a larger bag having an access opening therein and a carrying strap detachably connected thereto, a smaller bag detachably mounted on one side of the larger bag for support therefrom when assembled therewith and a detachable tray-like container of substantially rigid construction mounted on and forming a continuation of the bottom of the larger bag. The detachable carrying strap for the larger bag is removed therefrom and attached to the smaller bag when it is desirable to carry only the smaller bag.

U.S. Pat. No. 4,081,061, issued to Tucker, discloses a plurality of independent luggage pieces capable of functioning independently of one another and each having fastening means independent of their closures for securing the separate pieces together as a unitary structure as desired while being stored or in use.

U.S. Pat. No. 6,213,266, issued to Hollingsworth, discloses a modular luggage system includes wheeled flight bag with an externally demountable releasably attachable computer carrying case for carrying a delicate instrument such as a portable computer. The wheeled flight bag has wheels on a bottom wall and a retractable handle incorporated in an integral frame running up a back wall. The front of the flight bag includes a projecting member or salient tongue spaced a selected distance from a releasable fastening member. A computer carrying case adapted to be externally dismountable from the flight bag has a bottom wall and a back wall including a receiving slot or aperture for receiving the salient tongue mounted on the flight bag. The computer carrying case also includes a releasable fastening member spaced such that when the computer carrying bag is mounted upon the flight bag, the salient tongue is received in the receiving aperture and the computer carrying case fastening member locks, buckles or otherwise fastens with the cooperating fastening member mounted on the top surface of the flight bag. Preferably, the computer carrying case includes a carrying handle spaced apart from the back edge of the top wall. In use, one may grasp the computer carrying case handle with the right hand and, with the thumb, depress a button or otherwise actuate the releasable fastening member, thereby releasing the fastening members from one another, such that the computer carrying case may be lifted and withdrawn away from the flight bag. The computer carrying case preferably includes a shock absorbing suspension or impact absorbing cushions for providing protection to the delicate instrument enclosed within.

U.S. Patent Application Publication No.: 2008/0011567, by Hammond, discloses an improved storage bag has a retaining member disposed on an inside surface of a first side wall of a main bag. The retaining member allows supplemental bag to hang on an outside wall of the main bag. An existing storage bag can have a bracket configured to extend partially along an inside portion of a side wall of the briefcase. The bracket has a hook-portion to extend out of the top of the briefcase and partially along the outside portion of the side wall of the briefcase and a retaining member. This configuration also allows a supplemental bag to be attached to the retaining member to hang along an outside wall of the bag.

The inventions heretofore known suffer from a number of disadvantages which include: being difficult to manufacture, being difficult to assemble, being difficult to access stored items, not coupling efficiently, requiring the use of additional straps, having an easily accessible coupling mechanism, being difficult to detach, not having a secure coupling mechanism, and not protecting additional items.

What is needed is a bag system that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available bag systems. Accordingly, the present invention has been developed to provide a bag system.

In one embodiment of the invention, there is a bag system. The bag system may comprise a main bag. The main bag may include a front side. A slit may be disposed along the front side; and/or a buckle may be coupled to an interior surface of the front side. The bag system may also comprise a supplemental bag. The supplemental bag may be removably coupled to the main bag, and/or may include a connector. The connector may be disposed along a back side of the supplemental bag; and/or the connector may be disposed through the slit and/or removably coupled to the buckle. The connector and/or the buckle may thereby comprise a latch assembly.

In another embodiment of the invention, the latch assembly may include a connector. The connector may have a connector tongue. The latch assembly may also include a buckle. The buckle may be removably coupled to the connector. The buckle may have a buckle housing with an aperture. The connector tongue may be selectably disposable within the aperture. The buckle may also have a pair of levers, that may be partially disposed within the buckle housing. Each lever may be disposed along a side of the connector tongue when the connector tongue is disposed within the buckle housing, and/or thereby flanking the connector tongue.

Additionally, in one embodiment of the invention, the connector may be U-shaped. The connector may have a first member that may be coupled to the supplemental bag, a second member that may extend from the first member and/or a third member that may extend from the second member opposite the first member. The first and/or third members may be substantially parallel to each other such that they do not touch each other at distal ends thereof.

More, in one embodiment of the invention, the slit may be disposed through a middle region of the main bag that may be substantially equidistant from a mouth of the main bag and/or a bottom of the main bag such that the middle region may be orthogonal to the plane of the mouth and/or the plane of the bottom of the main bag. In an additional embodiment of the invention, the latch assembly may be a pinch latch. In yet another embodiment of the invention, each lever may be an actuator. Additionally, in one embodiment of the invention, the actuators may be buttons that may be disposed opposite each other on the latch assembly body. Too, in one embodiment of the invention, a profile of the connector may be U-shaped. Further, in one embodiment of the invention, the buckle may be a push button release buckle.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
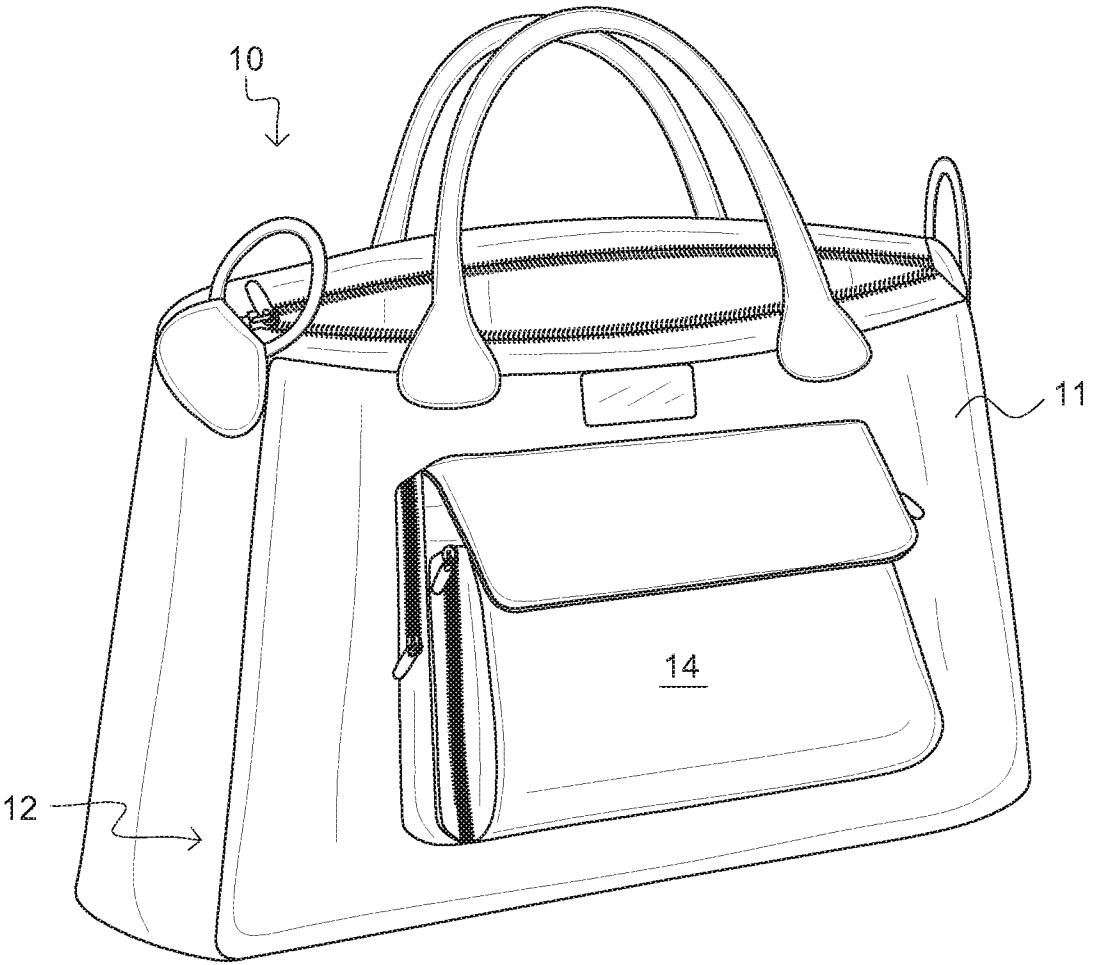
FIG. 1 is a front perspective view of a bag system, showing a main bag removably coupled to a supplemental bag, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a front perspective view of a bag system, showing a main bag removably coupled to a supplemental bag, according to one embodiment of the invention. There is shown a bag system 10 including a main bag 11. The main bag 11 has a front side of main bag 12. Coupled to the front side of main bag 12 is a supplemental bag 14.

As shown, the bag system 10 includes a main bag 11 and a supplemental bag 14. The main bag 11 and the supplemental bag 14 are configured to carry, house, protect, transport, etc. personal items. Accordingly, the main bag 11 and the supplemental bag 14 may be purses. The main bag 11 is shown to be larger than the supplemental bag 14; however, the main bag 11 may be smaller than, or identical to, the supplemental bag 14. The main bag 11 and the supplemental bag 14 may be comprised of a variety of materials, such as, but not limited to: leather, plastic, metal, cotton, and polyester. The main bag 11 and the supplemental bag 14 may have straps.

The supplemental bag 14 is removably coupled to the main bag 11 at the front side of main bag 12. The supplemental bag 14 may be secured to the front side 12 through a variety of couplings, such as, but not limited to: snaps, buckles, hook and loop, locks and ties. The supplemental bag 14 may be secured to the front side 12 so that it is not easily uncoupled from the main bag 11.

In operation, items are stored within the main bag 11. Items are also stored within the supplemental bag 14. The supplemental bag 14 is securely removably coupled to the main bag 11. The supplemental bag 14 is transported with the main bag 11. The supplemental bag 14 is removed from the main bag 11 with effort. The supplemental bag 14 may be uncoupled from the main bag 11 by a two-button (or other actuator type) latch assembly disposed within an interior the main bag 11 and extending through a slit in the body of the main bag, spaced from the mouth thereof. Accordingly, the supplemental bag 14 may only be uncoupled from the main bag 11 by accessing an interior of the main bag 11 through the mouth of the main bag.

Advantageously, a user of a such a bag need not be worried about someone surreptitiously removing the supplemental bag from the main bag so long as the mouth of the main bag is secure and/or under observation. Further, the slit through the main bag provides air circulation within the main bag even when the mouth is zipped closed. Additionally, wherein the latch assembly requires actuation of two buttons (or other actuator-type) to release the supplemental bag from the main bag, the user need not worry about items within the main bag accidentally releasing the supplemental bag from the main bag.

Figure 2:
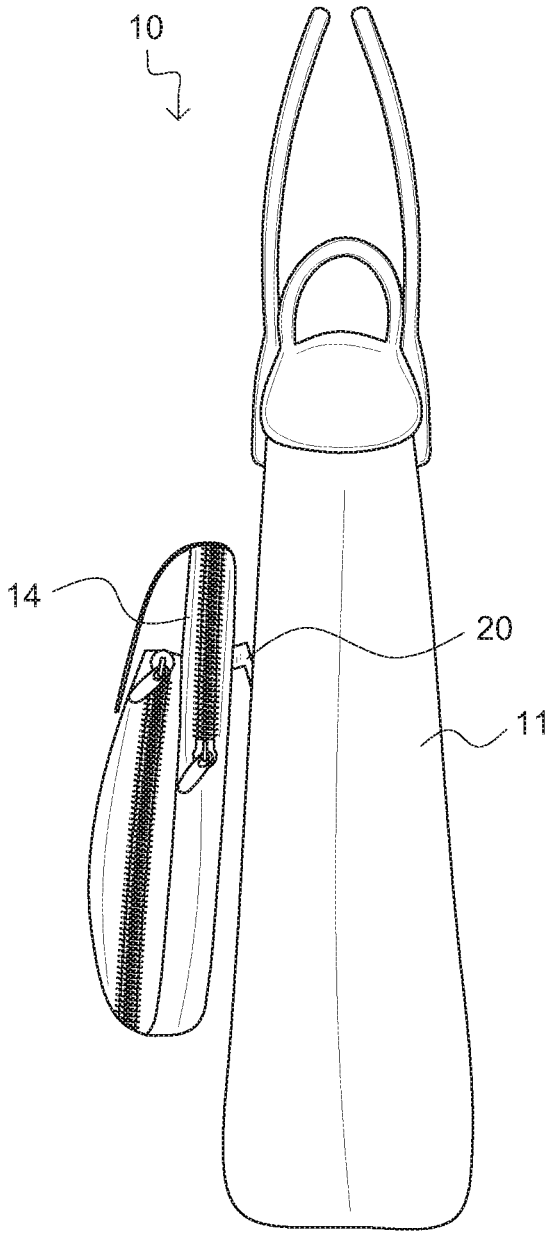
FIG. 2 is a side view of a bag system, showing a main bag removably coupled to a supplemental bag by a connector, according to one embodiment of the invention.

FIG. 2 is a side view of a bag system, showing a main bag removably coupled to a supplemental bag by a connector, according to one embodiment of the invention. There is shown a bag system 10 including a main bag 11. The main bag 11 is removably coupled to a supplemental bag 14 by a connector 20. The connector 20 is coupled to the supplemental bag 14 and disposed between the main bag 11 and the supplemental bag 14.

As shown, the supplemental bag 14 includes a connector 20. The connector is coupled to the supplemental bag 14 and extends outwardly therefrom toward the main bag 11. The connector 20 connects the supplemental bag 14 to the main bag 11. Accordingly, the connector 20 is disposed between the supplemental bag 14 and the main bag 11. The connector 20 may be a variety of connectors for coupling the supplemental bag 14 to the main bag, such as, but not limited to: belts, straps, ties, buckles, pinch latches, and push button latches. The connector 20 may be a pinch latch, such as, but not limited to, a Southco 60 Squeeze-Release Latch, by Southco, located at 210 N. Brinton Lake Road, Concordville, Pa. 19331. which is incorporated by reference herein. The connector may be a push button release buckle, such as, but not limited to, an Metal ⅝ Inch Side Release Buckle, by Paracord Planet, located at 1320 5$^{th}$ Ave. N., Fargo, N. Dak. 58102, which is incorporated by reference herein. The connector may be/include a latch assembly as described in U.S. patent application Ser. No. 16/455,487, which is incorporated by reference herein in its entirety. Accordingly, the connector 20 may be entirely comprised of rigid materials, such as, but not limited to: metal, plastic, and metal alloys.

Figure 3:
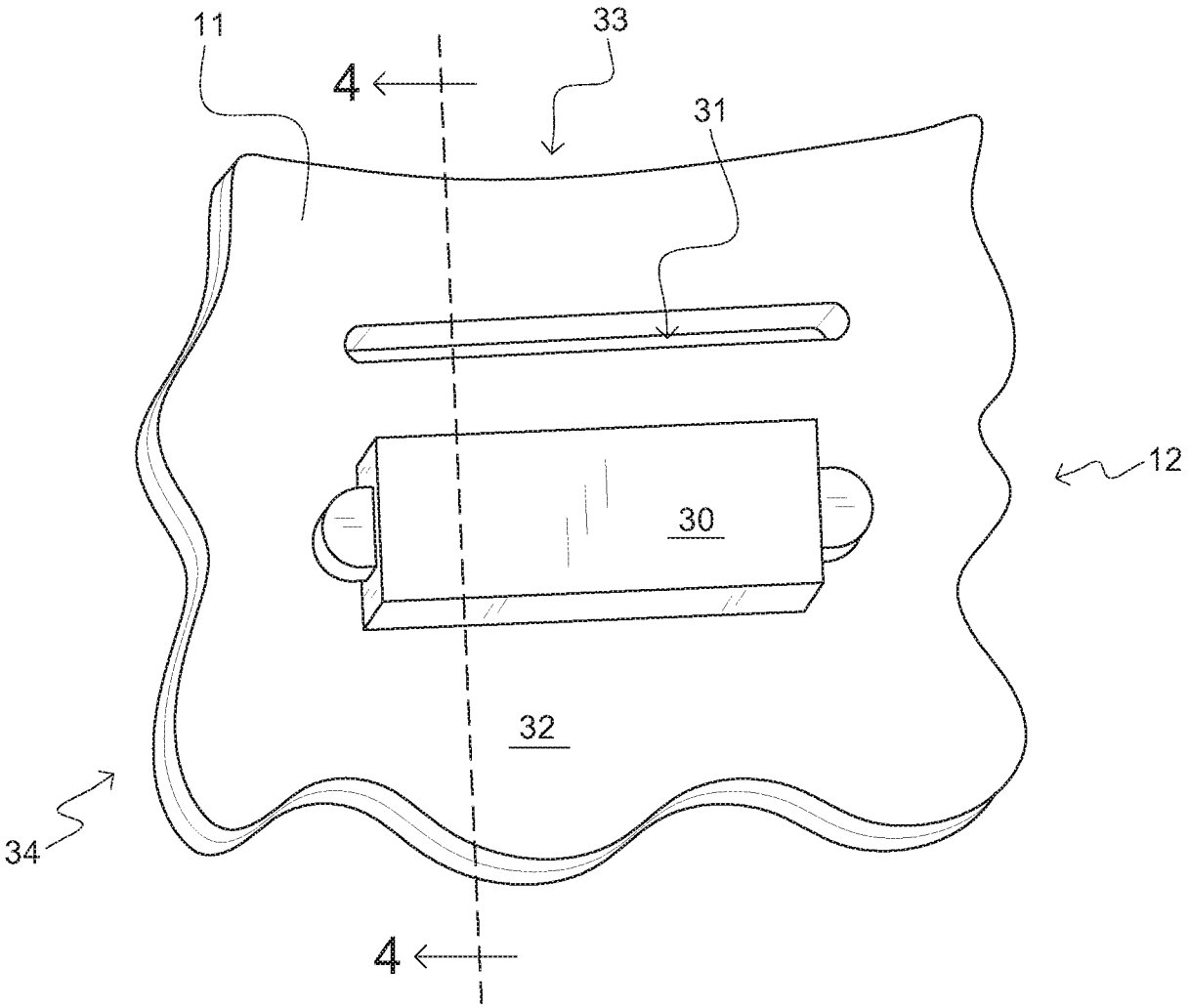
FIG. 3 is a sectional view of an interior surface of a front side of main bag, according to one embodiment of the invention.

FIG. 3 is a sectional view of an interior surface of a front side of main bag, according to one embodiment of the invention. There is shown a main bag 11 with a front side of main bag 12. Coupled to the front side of main bag 12 along an interior surface 32 is a buckle 30. A slit 31 is disposed above the buckle 30. The main bag 11 also has a mouth of main bag 33 and a bottom of main bag 34.

As shown, the front side of main bag 12 includes an interior surface 32. A buckle 30 is disposed along, and coupled to, the interior surface 32. A slit 31 is disposed along the interior surface 32 above the buckle 30. The slit 31 may allow the connector (See e.g., FIG. 2, Item 20) to enter the front side 12 into the main bag 11 and couple to the buckle 30. Accordingly, the slit 31 may be shaped and/or sized to permit the connector (See e.g., FIG. 2, Item 20) to enter the main bag 11 and couple to the buckle 30. The buckle 30 may only be accessed from within the main bag 11. As a result, when coupled to the buckle 30, the connector (See e.g., FIG. 2, Item 20) may only be uncoupled from the buckle 30 from within the main bag 11.

In one non-limiting embodiment, the slit 31 is disposed through a middle region of the main bag 11 that is substantially equidistant from the mouth of main bag 33 and the bottom of main bag 34, such that the middle region is orthogonal to a plane of the mouth 33 and a plane of the bottom 34 of the main bag 11. Accordingly, the slit 31 located a distance from the mouth of main bag 33 substantially equal to a distance from the bottom of main bag 34, and is thereby central to the mouth of main bag 33 and the bottom of main bag 34. The slit 31 is disposed along the interior surface 32 above the buckle 30, and between the buckle 30 and the mouth of main bag 33. However, in another non-limiting embodiment, the buckle 30 may be disposed above the slit 31. There may be additional slits disposed in other regions of the main bag. Further, there may be accessories that attach to an interior of the bag and do not pass through any slit.

Figure 4:
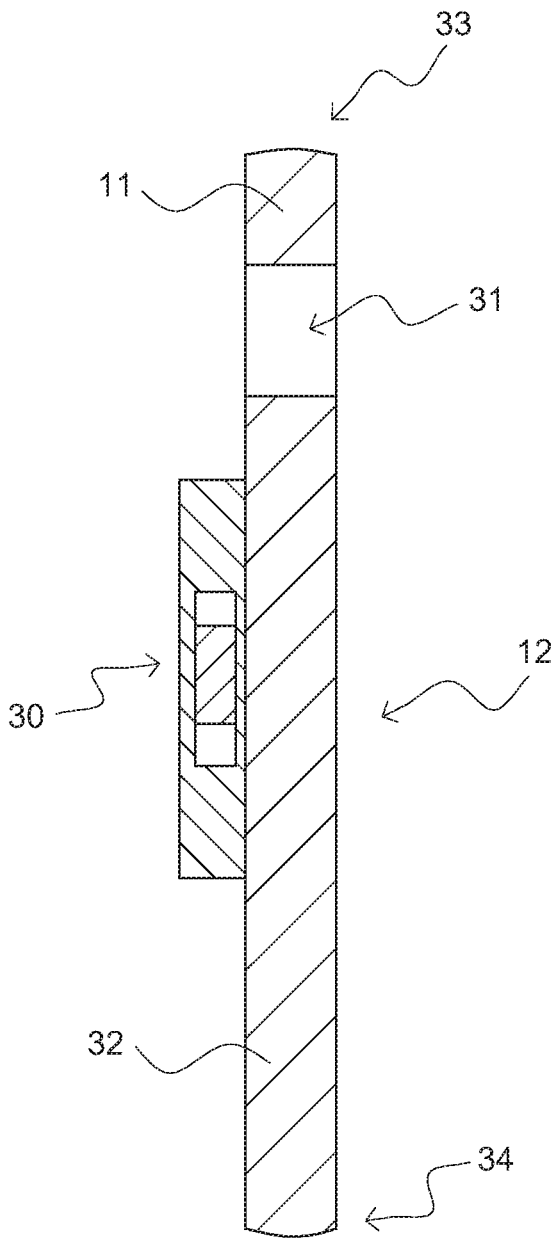
FIG. 4 is a sectional view of the interior surface of FIG. 3, showing the buckle, according to one embodiment of the invention.

FIG. 4 is a sectional view of the interior surface of FIG. 3, showing the buckle, according to one embodiment of the invention. There is shown a main bag 11 with an interior surface 32. Coupled to the interior surface 32, and disposed opposite the interior surface 32 of the front side 12, is a buckle 30. Also, disposed through the interior surface 32 is a slit 31. The main bag 11 additionally includes a mouth of main bag 33 and a bottom of main bag 34.

As shown, the main bag 11 includes a buckle 30. The buckle 30 is coupled to the main bag 11. Coupling structures are not shown; however, the buckle 30 may be coupled to the main bag 11 through a variety of couplings, such as, but not limited to: adhesives, rivets, screws, bolts, pins, clips, and snaps. The buckle 30 is disposed below the slit 31. The slit 31 provides an opening in the main bag 11 for a connector (See e.g., FIG. 2, Item 20) to pass through slit 31 and into the buckle 30 for removably coupling a supplemental bag (See e.g., FIG. 1, Item 14) to the main bag 11.

Figure 5:
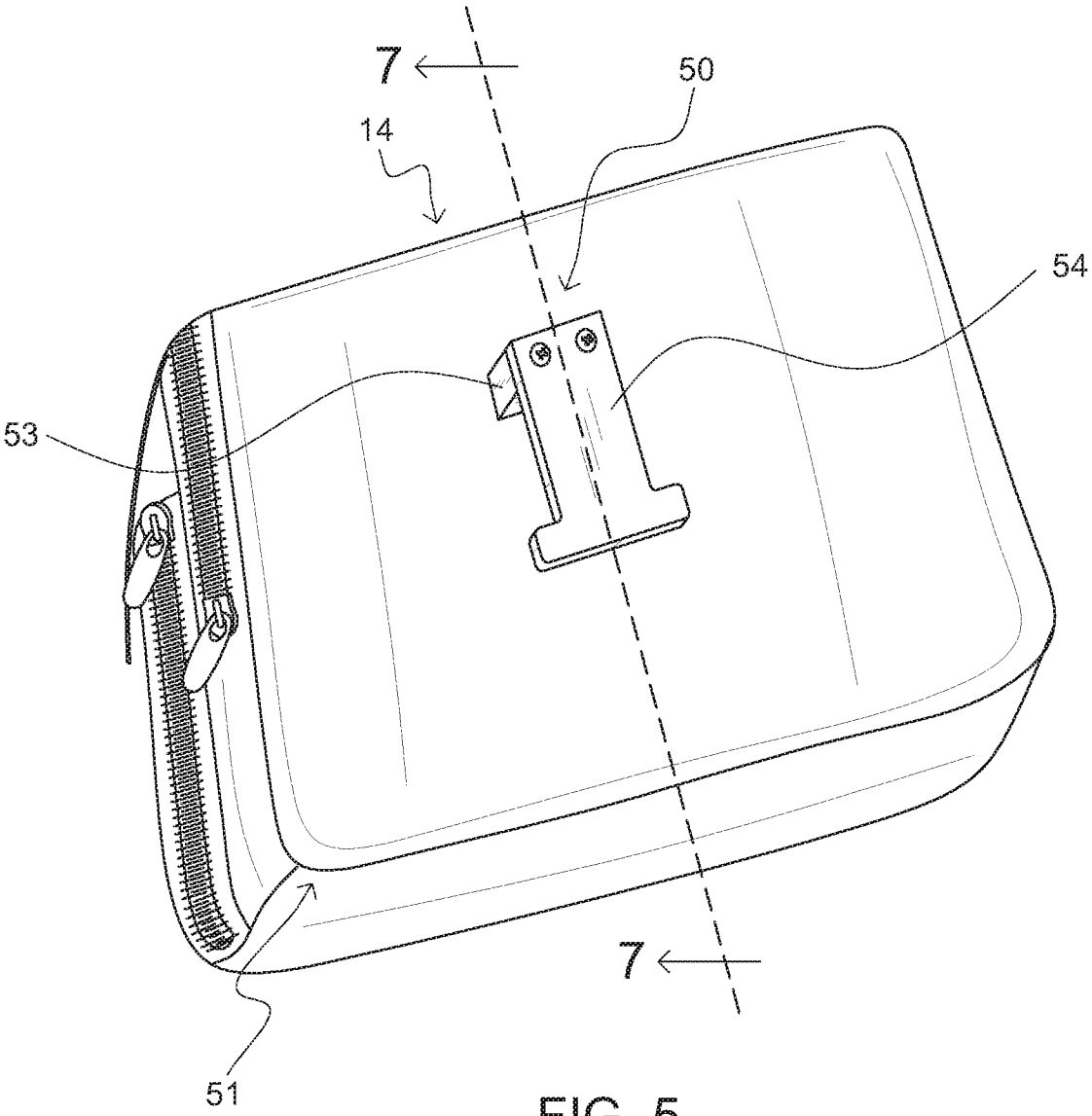
FIG. 5 is a back perspective view of a supplemental bag, showing a connector according to one embodiment of the invention.

FIG. 5 is a back perspective view of a supplemental bag, showing a connector according to one embodiment of the invention. There is shown a supplemental bag 14. A connector 50 is coupled to a back side of supplemental bag 51. The connector 50 includes a second member 53, and a third member 54 coupled to the second member 53.

As shown, the connector 50 includes a second member 53 coupled to the back side 51 and extending outwardly therefrom, orthogonal to the back side 51. A third member 54 is coupled to the second member 53 and extends outwardly from the second member, orthogonal to the second member 53 and planar to the back side. Accordingly, the third member 54 of the connector 50 extends to function as a tongue by projecting through a slit (See e.g., FIG. 3, Item 31) and into a buckle (See e.g., FIG. 3, Item 30) of a main bag (See e.g., FIG. 3, Item 11). The third member 54 of the connector 50 may enter a slit (See e.g., FIG. 3, Item 31) and removably couple to a buckle (See e.g., FIG. 3, Item 30) of a main bag (See e.g., FIG. 3, Item 11). The illustrated third member 54 is T-shaped.

Figure 6:
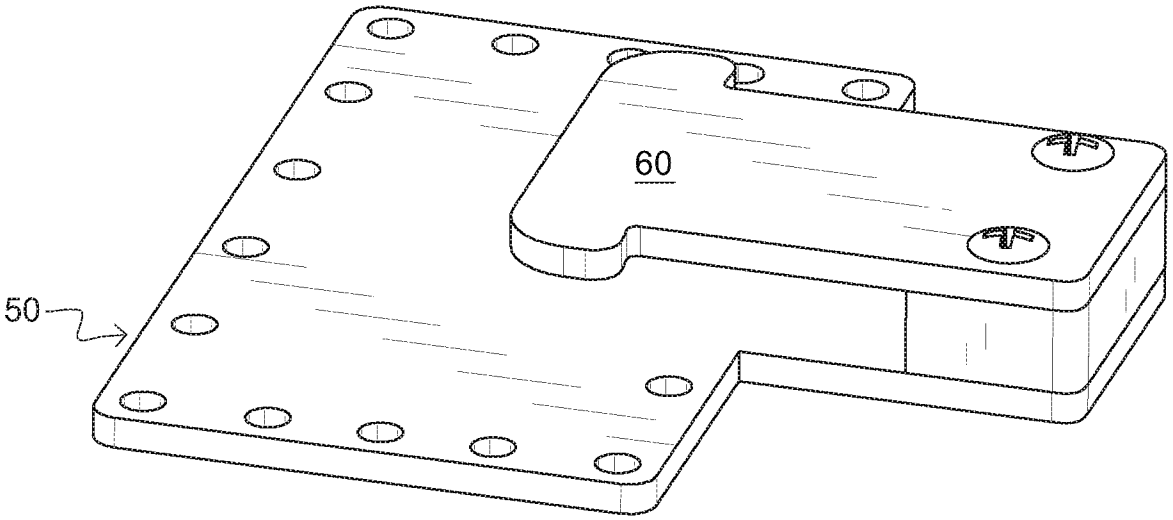
FIG. 6 is a side perspective view of a connector, showing a connector tongue, according to one embodiment of the invention.

FIG. 6 is a side perspective view of a connector, showing a connector tongue, according to one embodiment of the invention. There is shown a connector 50. The connector 50 includes a connector tongue 60.

As shown, the connector 50 includes a connector tongue 60. As shown, the connector 50 is U-shaped. The connector tongue 60 is T-shaped. The connector 50, including connector tongue 60, may be rigid and may not bend or give when force is applied. The connector 50, including connector tongue 60, may be comprised of metal.

Figure 7:
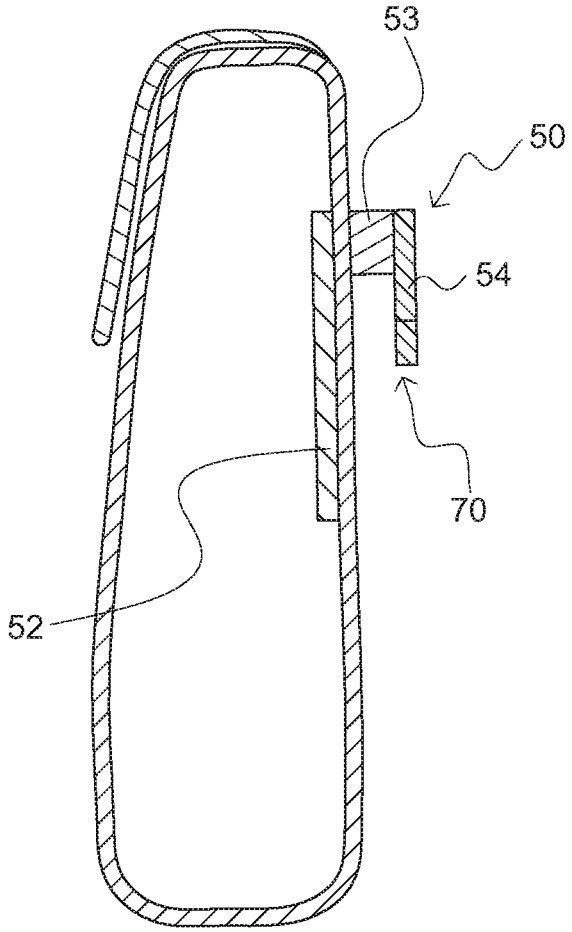
FIG. 7 is a side sectional view of the supplemental bag of FIG. 5, showing a profile of a connector according to one embodiment of the invention.

FIG. 7 is a side sectional view of the supplemental bag of FIG. 5, showing a profile of a connector according to one embodiment of the invention. For purposes of simplicity, structural details of the supplement bag itself (e.g. the closed zipper at the mouth, stitched seams, multiple layers of textile material, decorative elements) are not shown. There is shown a connector 50. The connector 50 includes a first member 52. Coupled to the first member 52 is a second member 53. Coupled to the second member 53 is a third member 54. In addition, the connector 50 has a profile 70.

As shown, the profile 70 of the connector 50 is U-shaped. The first member 52 is disposed within the supplemental bag (See e.g., FIG. 1, Item 14). The second and third members 53 and 54, respectively, are disposed outside of the supplemental bag (See e.g., FIG. 1, Item 14). As a result, the third member 54 of the connector 50 extends to function as a tongue by projecting through a slit (See e.g., FIG. 3, Item 31) and into a buckle (See e.g., FIG. 3, Item 30) of a main bag (See e.g., FIG. 3, Item 11).

In one non-limiting embodiment, the first member 52 is coupled to the supplemental bag (See e.g., FIG. 1, Item 14). The second member 53 extends from the first member 52, and the third member 54 extends from the second member 53 opposite the first member 52. The first and third members (52 and 54, respectively) are substantially parallel to each other such that they do not touch each other at distal ends thereof.

Figure 8:
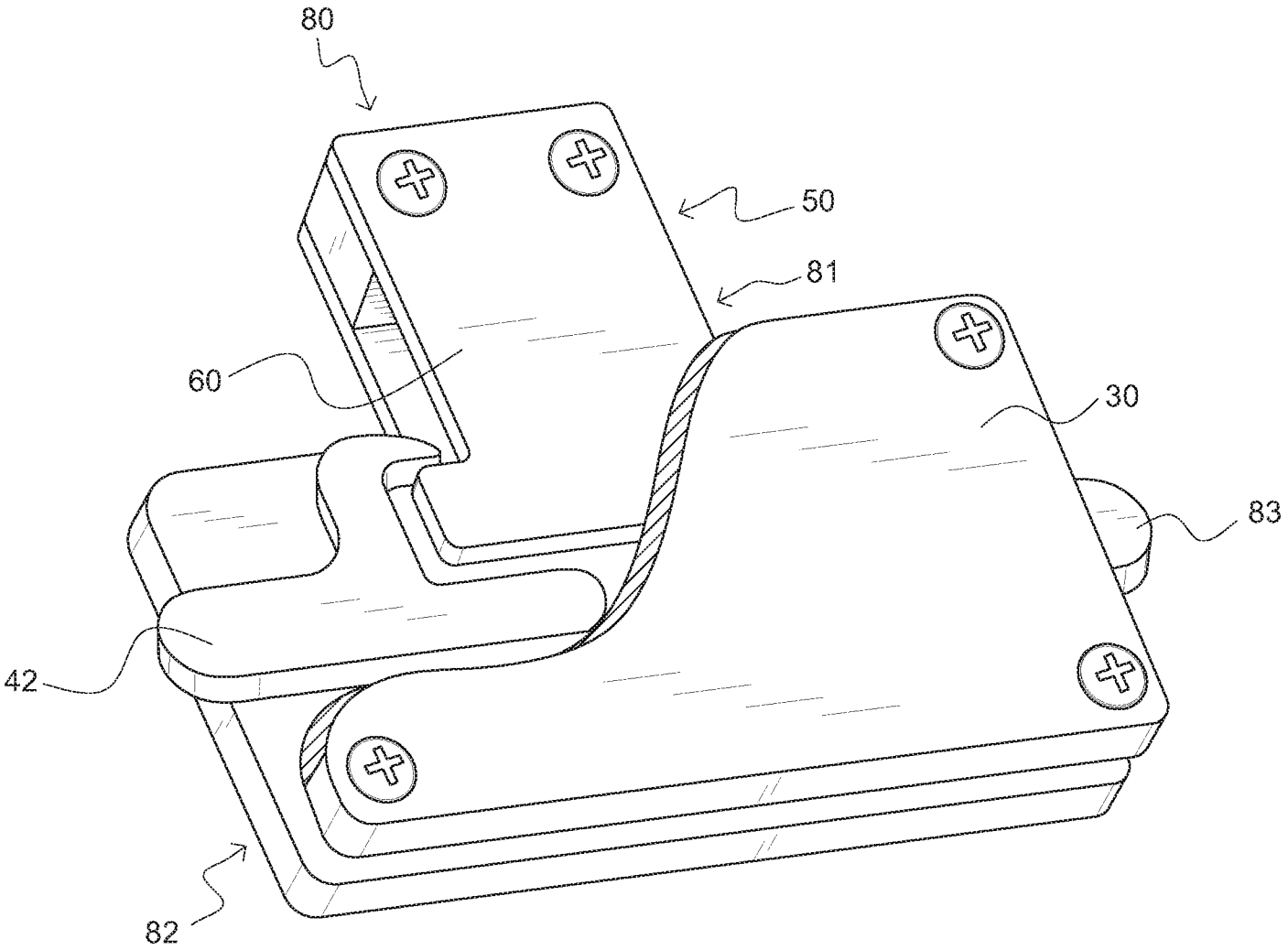
FIG. 8 is a partial front perspective view of a latch assembly, showing a buckle removably coupled to a connector, according to one embodiment of the invention.

FIG. 8 is a partial front perspective view of a latch assembly, showing a buckle removably coupled to a connector, according to one embodiment of the invention. There is shown a latch assembly 80. The latch assembly 80 includes a connector 50 removably coupled to a buckle 30. The buckle includes a buckle aperture 81 and buckle housing 82. The connector 50 includes a connector tongue 60. The connector tongue 60 is selectably disposed within the buckle aperture 81 and removably coupled to a pair of levers 83.

As shown, the buckle 30 includes a pair of levers 42, 83. The pair of levers 42, 83 may be rotatably coupled to the buckle housing 82 and may pivot about an axis. The pair of levers 42, 83 may pivot closed to couple to the connector tongue 60, and may pivot open to release the connector tongue 60. Accordingly, each lever 42, 83 may be an actuator, and may operate to couple and uncouple the connector tongue 60 to the buckle 30. More, the levers 42, 83, or actuators, may be buttons that are disposed opposite each other on the latch assembly 80. As a result, the pair of levers 42, 83 may function as push buttons for releasing the connector 50 from the buckle 30 upon simultaneous application of force to each lever 42, 83, or button.

The pair of levers 42, 83 are partially disposed within the buckle housing 81. Each lever 42, 83 is disposed along a side of the connector tongue 60 when the connector tongue 60 is disposed within the buckle housing 82, and thereby flank the connector tongue 60. Accordingly, a majority of the connector tongue 60 is disposed within the buckle 30 when the connector tongue 60 is coupled to the pair of levers 42, 83.

In one non-limiting embodiment of the invention, the connector tongue 60 may be disposed though the slit (See e.g., FIG. 3, Item 31) and removably coupled to the buckle 30. As a result, the connector 50 and the buckle 30 comprise the latch assembly 80 for latching the main bag (See e.g., FIG. 1, Item 11) to the supplemental bag (See e.g., FIG. 1, Item 14). For instance, in one non-limiting embodiment, the latch assembly 80 may be such as an Embossed Pinch Latch, by Vintage Trailer Supply, of 27556 E. I-25 Frontage Rd., Santa Fe, N. Mex. 87508, which is incorporated by reference herein. More, in another non-limiting embodiment, the latch assembly 80 may be such as a push button release buckle of a Metal Buckle with "GM" Push Button, by SeatBeltsPlus, of 1338 Rocky Point Dr., Oceanside, Calif. 92056, which is incorporated by reference herein. Accordingly, it may be that the levers 83, or actuators, may not be push buttons. Likewise, the levers 83, or actuators, may not be disposed opposite each other on the latch assembly 80.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the buckle is shown disposed on an interior of the main bag, the buckle may be disposed on an exterior of the main bag. Similarly, the connector, including connector tongue, may be disposed on an interior or exterior of the supplemental bag. Further, the supplemental bag may include a slit for allowing the buckle to travel through the slit into an interior of the supplemental bag.

It is expected that there could be numerous variations of the design of this invention. An example is that the main bag and/or supplemental bag may have any size and/or shape for transporting personal items. Additionally, although the figures illustrate the main bag and the supplemental bag as purses, it is envisioned that any type of bag may be used for the bag system, such as but not limited to: purses, backpacks, briefcases, computer cases, and luggage. It is also envisioned that the buckle may be hidden in the main bag by a divider, or pocket, of the main bag.

Finally, it is envisioned that the components of the device may be constructed of a variety of materials, such as, but not limited to: plastic, textiles, leather, metal, rubber, etc. and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A bag system, comprising:

a. a main bag made of a flexible material, including a front side, wherein:

i. a slit is disposed along the front side and extends through an entire thickness of the front side from an exterior of the main bag to a cavity of the bag; and ii. a buckle is coupled to an interior surface of the front side; and b. a supplemental bag, removably coupled to the main bag, and including a pin, wherein:

i. the pin is disposed along a back side of the supplemental bag;

ii. the pin is spaced from the back side of the supplemental bag; and iii. the pin is disposed through the slit and removably coupled to the buckle, the pin and the buckle thereby comprising a latch assembly.

2. The bag system of claim 1, wherein the latch assembly includes:

a. the pin having a connector tongue; and b. a buckle, removably coupled to the pin, the buckle having:

i. a buckle housing with an aperture, wherein the connector tongue is selectably disposable within the aperture; and ii. a pair of levers, partially disposed within the buckle housing, each lever being disposed along a side of the connector tongue when the connector tongue is disposed within the buckle housing, and thereby flanking the connector tongue.

3. The bag system of claim 1, wherein the pin is U-shaped, having a first member coupled to the supplemental bag, a second member extending from the first member and a third member extending from the second member opposite the first member, wherein the first and third members are substantially parallel to each other such that they do not touch each other at distal ends thereof.

4. The bag system of claim 1, wherein the slit is disposed through a middle region of the main bag that is substantially equidistant from a mouth of the main bag and a bottom of the main bag such that the middle region is orthogonal to a plane of the mouth and a plane of the bottom of the main bag.

5. The bag system of claim 1, wherein the latch assembly is a pinch latch.

6. The bag system of claim 1, wherein each lever is an actuator.

7. The bag system of claim 6, wherein the actuators are buttons that are disposed opposite each other on the latch assembly body.

8. The bag system of claim 1, wherein a profile of the pin is U-shaped.

9. The bag system of claim 1, wherein the buckle is a push button release buckle.

10. A bag system, comprising:

a. a main bag made of a flexible material and having a cavity accessible from an aperture in a top side thereof, and including a front side, wherein:

i. a slit is disposed along the front side, the slit extending from an exterior of the main bag through to the cavity of the bag; and ii. a buckle is coupled to an interior surface of the front side; and b. a supplemental bag, removably coupled to the main bag, and including a connector, wherein:

i. the connector is disposed along a back side of the supplemental bag; and ii. the connector is disposed through the slit and removably coupled to the buckle, the connector and the buckle thereby comprising a latch assembly;

c. wherein the connector includes a rigid tongue; and d. wherein the buckle includes:

i. a buckle housing with an aperture, wherein the rigid tongue is selectably disposable within the aperture; and ii. a pair of levers, partially disposed within the buckle housing, each lever being disposed along a side of the rigid tongue when the rigid tongue is disposed within the buckle housing, and thereby flanking the rigid tongue.

11. The bag system of claim 10, wherein the connector is U-shaped, having a first member coupled to the supplemental bag, a second member extending from the first member and a third member extending from the second member opposite the first member, wherein the first and third members are substantially parallel to each other such that they do not touch each other at distal ends thereof.

12. The bag system of claim 11, wherein the slit is disposed through a middle region of the main bag that is substantially equidistant from a mouth of the main bag and a bottom of the main bag such that the middle region is orthogonal to a plane of the mouth and a plane of the bottom of the main bag.

13. The bag system of claim 12, wherein a portion of the third member is disposed within the buckle.

14. The bag system of claim 13, wherein the latch assembly is a pinch latch.

15. The bag system of claim 14, wherein a profile of the connector is U-shaped.

16. The bag system of claim 15, wherein each lever is an actuator.

17. The bag system of claim 16, wherein the actuators are buttons that are disposed opposite each other on the latch assembly body.

18. The bag system of claim 17, wherein the connector is rigid.

19. The bag system of claim 18, wherein the connector is metal.

20. A bag system, comprising:

a. a main bag made of a flexible material, including a front side, wherein:

i. a slit is disposed along the front side through a middle region of the main bag that is substantially equidistant from a mouth of the main bag and a bottom of the main bag such that the middle region is orthogonal to a plane of the mouth and a plane of the bottom of the main bag, the slit extending through the front side of the main bag from an exterior of the main bag through to a cavity of the bag and accessible from an interior thereof through the mouth; and ii. a buckle is coupled to an interior surface of the front side; and b. a supplemental bag, removably coupled to the main bag, and including a connector, wherein:

i. the connector is disposed along a back side of the supplemental bag;

ii. the connector is disposed through the slit and removably coupled to the buckle, the connector and the buckle thereby comprising a latch assembly;

c. wherein the latch assembly is a pinch latch wherein:

i. the connector includes a rigid tongue, and wherein the connector is U-shaped, having a first member coupled to the supplemental bag, a second member extending from the first member and a third member extending from the second member opposite the first member, wherein the first and third members are substantially parallel to each other such that they do not touch each other at distal ends thereof; and ii. the buckle includes: a buckle housing with an aperture, wherein the rigid tongue is selectably disposable within the aperture; and a pair of levers, partially disposed within the buckle housing, each lever being disposed along a side of the connector tongue when the connector tongue is disposed within the buckle housing, and thereby flanking the connector tongue, wherein each lever is an actuator, and wherein the actuators are buttons that are disposed opposite each other on the latch assembly body.

* * * * *